United States Patent [19]

Koizumi et al.

[11] 4,168,449

[45] Sep. 18, 1979

[54] ROTARY ANODE FOR X-RAY TUBE AND A METHOD FOR MANUFACTURING THE SAME

[75] Inventors: Hideo Koizumi, Machida; Shigeharu Nishino, Kunitachi; Michiyasu Komatsu, Yokohama; Tadashi Miyano, Sagamihara, all of Japan

[73] Assignee: Tokyo Shibaura Electric Co., Ltd., Kawasahi, Japan

[21] Appl. No.: 845,716

[22] Filed: Oct. 26, 1977

[30] Foreign Application Priority Data

| | | | |
|---|---|---|---|
| Oct. 29, 1976 | [JP] | Japan | 51/130149 |
| Oct. 29, 1976 | [JP] | Japan | 51/130150 |
| Oct. 29, 1976 | [JP] | Japan | 51/130152 |

[51] Int. Cl.[2] ..... H01J 35/08

[52] U.S. Cl. ..... 313/330; 313/60; 313/311; 29/25.14

[58] Field of Search ..... 313/330, 311, 60; 29/25.14

[56] References Cited

U.S. PATENT DOCUMENTS

| | | | |
|---|---|---|---|
| 3,579,022 | 8/1968 | Hennig | 313/330 |
| 3,649,355 | 3/1972 | Hennig | 313/330 |
| 3,737,699 | 6/1973 | Gager | 313/330 |
| 4,119,879 | 10/1978 | Devine, Jr. | 313/311 |
| 4,132,917 | 1/1979 | Bildstein et al. | 313/330 |

FOREIGN PATENT DOCUMENTS

| | | | |
|---|---|---|---|
| 50-79289 | 6/1975 | Japan | 313/330 |

*Primary Examiner*—Saxfield Chatmon, Jr.
*Attorney, Agent, or Firm*—Cushman, Darby & Cushman

[57] ABSTRACT

A rotary anode for an X-ray tube comprising an anode body formed of graphite, a target layer formed of tungsten or alloy thereof, and an intermediate layer containing rhenium and molybdenum, the intermediate layer being interposed between and bonded with the anode body and target layer. This rotary anode may be obtained by forming over a target area of the graphite anode body a paste layer containing rhenium powder and molybdenum powder, laminating over the paste layer a layer formed of tungsten or alloy thereof, and then hot-pressing the resultant laminated body under vacuum or in an inert gas by means of a pressure transmitting powder.

15 Claims, 3 Drawing Figures

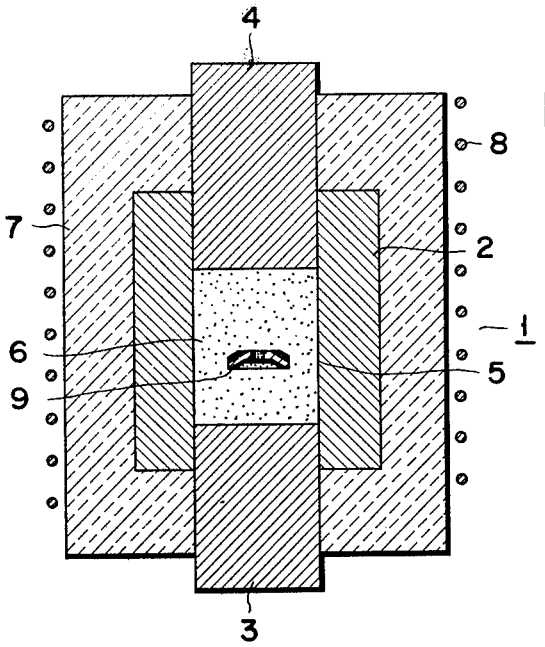
FIG. 1
FIG. 2
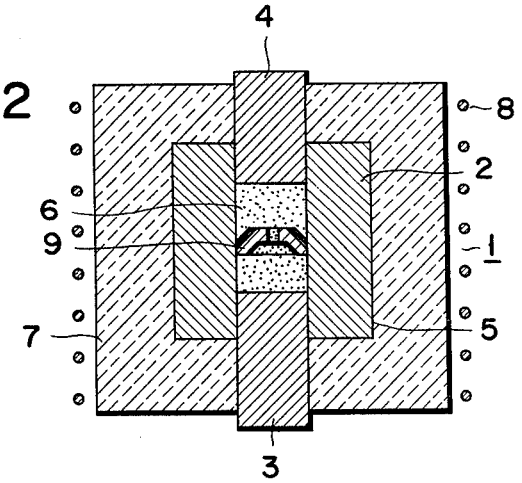
FIG. 3
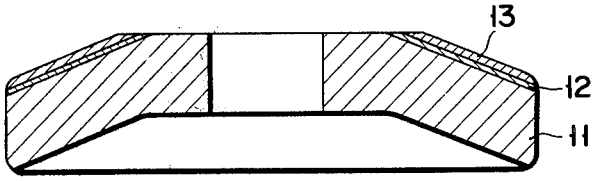

ROTARY ANODE FOR X-RAY TUBE AND A METHOD FOR MANUFACTURING THE SAME

BACKGROUND OF THE INVENTION

This invention relates to a rotary anode for an X-ray tube, more specifically to an improvement of an intermediate layer or a bonding layer to bond an anode body to a target layer of such rotary anode.

X-ray tubes, especially those for medical application, have a rapidly rotating rotary anode formed of tungsten and a cathode facing opposite to the anode within a glass envelope kept under high-degree vacuum. The target layer formed over a target area of the rotary anode is bombarded with electron beams emitted from the cathode, and consequently the target layer emits X-rays.

Rotary anodes with large thermal capacities allow good heating radiation, thereby providing a large X-ray output.

Since molybdenum has larger thermal capacity and lower specific gravity as compared with tungsten, such rotary anodes composed of a laminate of molybdenum and tungsten layers are known. Also, there have been proposed rotary anodes comprising a graphite anode body to which there is bonded a target layer formed of tungsten or tungsten-rhenium alloy. Such rotary anodes are advantageous because graphite has larger thermal capacity as compared with tungsten and molybdenum. The defective point, however, is that tungsten and graphite would react to each other to form a brittle intermediate layer, thereby deteriorating the rotary anode.

U.S. Pat. No. 3,579,022 issued on May 18, 1971 entitled "Rotary anode for X-ray tube" eliminates the above defect by bonding the graphite anode body with the tungsten-rhenium alloy target layer by means of an intermediate layer of rhenium. In this U.S. patent the target layer and intermediate layer are both formed by taking advantage of the thermal decomposition of corresponding metal compounds.

The Japanese Patent application first disclosed under No. 79289/75 issued on June 27, 1975, assigned to the assignee of the present invention, is intended as an improvement of the aforesaid U.S. Pat. No. 3,579,022. According to this Japanese patent application, the anode body of graphite and the target layer of tungsten or its alloy are bonded by means of an intermediate layer of molybdenum or molybdenum-ruthenium alloy, and intermediate layer being formed by applying to the target area of the anode body a paste containing molybdenum powder or a paste containing molybdenum powder and ruthenium powder, laying a preformed tungsten sheet or band on the applied layer, and then hot-pressing the resultant laminated body under vacuum or in an inert gas.

SUMMARY OF THE INVENTION

An object of the present invention is to provide a rotary anode for an X-ray tube with high bonding strength between anode body and target layer.

Another object of the invention is to provide X-ray tube rotary anodes whose bonding strength only slightly varies among themselves.

Still another object of the invention is to provide a method for firmly bonding to the anode body of graphite a preformed sheet or band of tungsten or its alloy to function as a target layer.

A further additional object of the invention is to provide a rotary anode for an X-ray tube to ensure high X-ray output.

The rotary anode for an X-ray tube according to the invention comprises an anode body formed of graphite, a target layer formed of tungsten or its alloy, and an intermediate layer containing rhenium and molybdenum interposed between and bonded with the anode body and target layer. The intermediate layer should preferably contain 30 to 90 weight % of rhenium.

The intermediate layer may be formed by applying on to a target area of the graphite anode body a paste containing rhenium powder and molybdenum powder, laying on the applied layer a preformed sheet or band, as a target layer, formed of tungsten or its alloy, and then hot-pressing these layers under vacuum or in an inert gas by means of a pressure transmitting powder.

The intermediate layer should preferably be 5 to 800 microns thick, further preferably 10 to 500 microns thick.

Hot-pressing should preferably be performed at a temperature of 1,500° to 2,000° C., under a pressure of 200 to 1,000 kg/cm$^2$ for 30 to 120 minutes.

The preferred average particle size of the rhenium powder may range from 1 to 10 microns.

The preferred average particle size of the molybdenum powder may range from 0.5 to 4 microns.

As the pressure transmitting powder use is made of a powder which is not reacted with the anode component material and which is not formed into a mass by subjection to heating and compression.

Preferred examples of the pressure transmitting powder include boron nitride powder.

The materials composing the target layer of the invention include pure tungsten, tungsten doped with impurities such as $SiO_2$, $K_2O$, $Al_2O_3$, Fe etc. Tungsten-rhenium alloy, and tungsten-tantalum alloy.

The paste layer may be two-layer structure having a first layer is contact with the anode body and a second layer formed on the first layer to be in contact with the target layer. In this case, the first layer preferably includes a large amount of rhenium, for example, 70–90 wt% of rhenium based on the whole weight of rhenium and molybdenum, and the second layer preferably includes, unlike the first layer, a large amount of molybdenum.

BRIEF DESCRIPTION OF THE DRAWINGS

FIG. 1 is a sectional view of the device for manufacturing the rotary anode for X-ray tube of this invention;

FIG. 2 is a sectional view of the device similar to that of FIG. 1 showing an alternative embodiment; and FIG. 3 is a sectional view of the rotary anode showing the configuration thereof prior to hot-pressing.

DETAILED DESCRIPTION OF THE PREFERRED EMBODIMENTS

FIG. 1 shows a device suitable for the hot-pressing operation according to this invention.

In a molding container 1 is disposed a mold 2. A member 3 and a plunger 4 are inserted in lower and upper openings of the mold 2 respectively. Thus, a space defined by the mold 2, member 3 and plunger 4 forms a molding chamber 5. This molding chamber 5 is filled with a pressure transmitting powder 6 such as boron nitride powder. The mold 2 is enclosed by an adiabatic filler 7, which forms an external wall of the molding container 1. Outside the adiabatic filler 7 is arranged an induction coil 8 for heating.

The mold 2 can also be directly heated by a resistance heating and no adiabatic filler 7 is necessary in this case. Numeral 9 denotes a to be-pressed article embedded in the pressure transmitting powder 6 in a state prior to hot-pressing. The to be-pressed article 9 comprises an anode body formed of graphite, a paste layer containing rhenium powder and molybdenum powder and formed over a target area of the anode body, and a target layer formed of tungsten or its alloy and laid on the paste layer. In hot-pressing the induction coil 8 is to be operated while lowering the plunger 4. Hot-pressing by using the pressure transmitting powder 6 may uniformly apply pressure to the to be-pressed article independently of the shape thereof. Even if the contact surface of the anode body and target layer is more or less subject to unevenness, there will be caused no local defective bonding, owing to the uniform pressure applied to the whole area of the contact surface. The boron nitride is advantageous for use because it hardly reacts to graphite and tungsten during hot-pressing. The pressure may be applied to the to be-pressed article by means of the pressure transmitting powder 6 from both top and bottom directions only as shown in FIG. 2. In FIG. 2 parts or portions identical with those in FIG. 1 are all denoted by the same respective numerals.

This invention will be more fully be understood from the following detailed description of the examples.

EXAMPLE 1

Molybdenum powder with the average particle size of 1.5μ was mixed with rhenium powder with the average particle size of 2μ at a mixture ratio of 50:50 by weight. To this mixture was added 1.5% by weight of an organic binder, which was fully agitated to prepare a paste. This paste was applied to the target area of the graphite anode body 11 as shown in FIG. 3 to form a paste layer 12. On top of the paste layer 12 was laid a conically shaped target layer 13 formed of tungsten. The resultant laminated body was hot-pressed by using the hot-presser as shown in FIG. 1 under the following conditions. That is, the laminated body was heated under vacuum to a temperature of 1,200° C. with boron nitride powder used as the pressure transmitting powder, and further heated to 1,650° C. under nitrogen gas atmosphere and subjected at this temperature to a pressure of 200 kg/cm$^2$ for 30 minutes. Consequently, the paste layer 12 was changed into an intermediate layer substantially consisting of rhenium and molybdenum alloy and having a thickness of approximately 300 microns, which was bonded with the graphite anode body as well as the tungsten target layer. An electron-microscopic examination of the sections of these bonded surfaces revealed no formation of tungsten carbide which is liable to form a brittle intermediate layer.

EXAMPLE 2

Molybdenum powder with the average particle size of 1μ was mixed with rhenium powder with the average particle size of 2.5μ at a mixture ratio of 50:50 by weight. To this mixture was added an organic binder at 0.5 to 3% by weight, which was fully agitated to prepare a paste. This paste was applied to the target area of the anode body in the same manner as in Example 1 to form the paste layer. On top of the paste layer was laid the conically shaped target layer formed of tungsten. The resultant laminated body was hot-pressed under vacuum at a temperature of 1,600° to 2,000° C. and pressure of 300 kg/cm$^2$ for 60 minutes, by using boron nitride powder as the pressure transmitting powder.

Consequently, the paste layer was changed into an approximately 200 microns thick intermediate layer substantially consisting of rhenium-molybdenum alloy, which was firmly bonded with the graphite anode body as well as the tungsten target layer. The adhesive strength of thus manufactured anode of this invention was found to be 10 to 20% higher than that of a rotary anode manufactured in the same manner as in the aforementioned example of this invention excepting the use of a paste composed of a combination of molybdenum powder and organic binder, a combination of rhenium powder and organic binder, or a combination of ruthenium powder, molybdenum powder and organic binder. Further, the variation in bonding strength of ten rotary anodes of the invention obtained according to this example is as low as 20% and below. On the other hand, that of ten rotary anodes manufactured with the above-mentioned conventional combination pastes was found to be as high as 20 to 200%.

What we claim is:

1. A rotary anode for an X-ray tube comprising an anode body formed of graphite, a target layer of a preformed sheet or band formed of tungsten or an alloy thereof, and an intermediate layer consisting essentially of a mixture of both rhenium and molybdenum, said intermediate layer being interposed between and firmly bonded to said anode body and said target layer.

2. A rotary anode for an X-ray tube according to claim 1, wherein said intermediate layer contains rhenium in an amount of from 30 to 90% by weight, the balance consisting essentially of molybdenum.

3. A rotary anode for an X-ray tube according to claim 1, wherein said intermediate layer is 5μ to 800μ thick.

4. A method for manufacturing a rotary anode for an X-ray tube comprising (1) applying a paste containing a mixture of rhenium powder and molybdenum powder on to a target area of an anode body formed of graphite to form a layer, (2) laminating on the thus applied layer a sheet formed of preformed tungsten or an alloy thereof to form a target layer, and then (3) hot-pressing the resultant laminated body under vacuum or in an inert gas by means of a pressure transmitting powder, thereby bonding said anode body to said preformed tungsten target layer sheet.

5. A method for manufacturing a rotary anode for an X-ray tube according to claim 4, wherein said pressure transmitting powder is boron nitride powder.

6. A method for manufacturing a rotary anode for an X-ray tube according to claim 4, wherein the amount of said rhenium powder is used in an amount of from 30 to 90% by weight of the total amount of said mixture of rhenium powder and molybdenum powder.

7. A method for manufacturing a rotary anode for an X-ray tube according to claim 4, wherein said hot-pressing is performed at a temperature of 1,500° to 2,000° C. under a pressure of 200 to 1,000 kg/cm$^2$ for 30 to 120 minutes.

8. A rotary anode for an X-ray tube according to claim 1, wherein said intermediate layer comprises a first layer in contact with said anode body and a second layer formed on said first layer, said first layer containing more rhenium than molybdenum and the second layer containing more molybdenum than rhenium, the amount of rhenium and molybdenum in each of said first and second layers being based on the total weight of the rhenium and molybdenum.

9. A rotary anode for an X-ray tube according to claim 3, wherein said intermediate layer is 10 to 500 microns thick.

10. A method for manufacturing a rotary anode for an X-ray tube comprising the steps of:

(a) Apply to the target area of a graphite anode body a paste containing a mixture of rhenium powder and molybdenum powder to form an intermediate layer;

(b) Laminating onto the thus applied intermediate layer a sheet or layer of preformed tungsten or an alloy thereof to form a target layer; and thereafter (c) Subjecting the assembly of graphite anode, intermediate layer and tungsten target layer to hot-pressing in a pressure-transmitting powder and applying pressure uniformly to the entire surface of the assembly under a vacuum or in an inert gas, thereby firmly bonding the graphic body and intermediate layer to the preformed tungsten target.

11. A method for manufacturing a rotary anode for an X-ray tube according to claim 10 wherein said intermediate layer consists of a first layer containing more rhenium than molybdenum in contact with the graphite anode body and a second layer containing more molybdenum than rhenium in contact with said first layer and said tungsten target layer.

12. A method for manufacturing a rotary anode for an X-ray tube according to claim 10 wherein said rhenium powder represents from 30 to 90% by weight of the total amount of said mixture.

13. A method for manufacturing a rotary anode for an X-ray tube according to claim 12 wherein the average particle size of said rhenium powder is from 1 to 10 microns.

14. A method for manufacturing a rotary anode for an X-ray tube according to claim 12 wherein the average particle size of said molybdenum powder is from 0.5 to 4 microns.

15. A method for manufacturing a rotary anode for an X-ray tube according to claim 12 wherein the pressure-transmitting powder is boron nitride powder.

* * * * *